US008931720B2

(12) United States Patent
Box et al.

(10) Patent No.: US 8,931,720 B2
(45) Date of Patent: Jan. 13, 2015

(54) METHOD OF SORTING MINED, TO BE MINED OR STOCKPILED MATERIAL TO ACHIEVE AN UPGRADED MATERIAL WITH IMPROVED ECONOMIC VALUE

(75) Inventors: John Clarence Box, Perth (AU); Trevor Heuer, Mindarie (AU)

(73) Assignee: Technological Resources Pty. Limited, Melbourne, Victoria (AU)

( * ) Notice: Subject to any disclaimer, the term of this patent is extended or adjusted under 35 U.S.C. 154(b) by 673 days.

(21) Appl. No.: 13/124,315

(22) PCT Filed: Oct. 16, 2009
(Under 37 CFR 1.47)

(86) PCT No.: PCT/AU2009/001364

§ 371 (c)(1),
(2), (4) Date: Feb. 27, 2012

(87) PCT Pub. No.: WO2010/042994

PCT Pub. Date: Apr. 22, 2010

(65) Prior Publication Data

US 2012/0256022 A1 Oct. 11, 2012

(30) Foreign Application Priority Data

Oct. 16, 2008 (AU) ..... 2008905365

(51) Int. Cl.
*B02C 9/04* (2006.01)
*B07B 15/00* (2006.01)
*E21C 41/26* (2006.01)

(52) U.S. Cl.
CPC ..... *B07B 15/00* (2013.01); *E21C 41/26* (2013.01)
USPC ..... 241/24.1; 241/30; 209/576; 209/577; 209/589

(58) Field of Classification Search
USPC ..... 241/101.3, 230–233, 259.1, 259.3; 209/576, 577, 589
See application file for complete search history.

(56) References Cited

U.S. PATENT DOCUMENTS 3,908,912 A * 9/1975 Irons et al. ..... 241/20
3,936,372 A * 2/1976 Frangiskos ..... 209/3
3,966,593 A * 6/1976 Larsson ..... 209/479

(Continued)

FOREIGN PATENT DOCUMENTS

CA 1 143 591 3/1983
CA 1143591 A * 3/1983 ..... G01N 1/10

(Continued)

OTHER PUBLICATIONS

International Search Report from the Australian Patent Office for International Application No. PCT/AU2009/001364, mailed Jan. 12, 2010.

*Primary Examiner* — Mark Rosenbaum
*Assistant Examiner* — Onekki Jolly
(74) *Attorney, Agent, or Firm* — Banner & Witcoff, Ltd.

(57) ABSTRACT

A method of sorting material that comprises determining whether a volume of material to be mined or a volume of stockpiled material is upgradable to produce a supply of material of greater economic value. If the determination is positive, the material is dry sorted to increase the grade or economic value. The determination is done by taking a plurality of samples from the initial volume of material and analyzing the material to determine if the material is able to be upgraded. The determination can be by X-Ray analysis. The upgrading can involve a size reduction step.

22 Claims, 7 Drawing Sheets

(56) References Cited

U.S. PATENT DOCUMENTS

Figure 1:
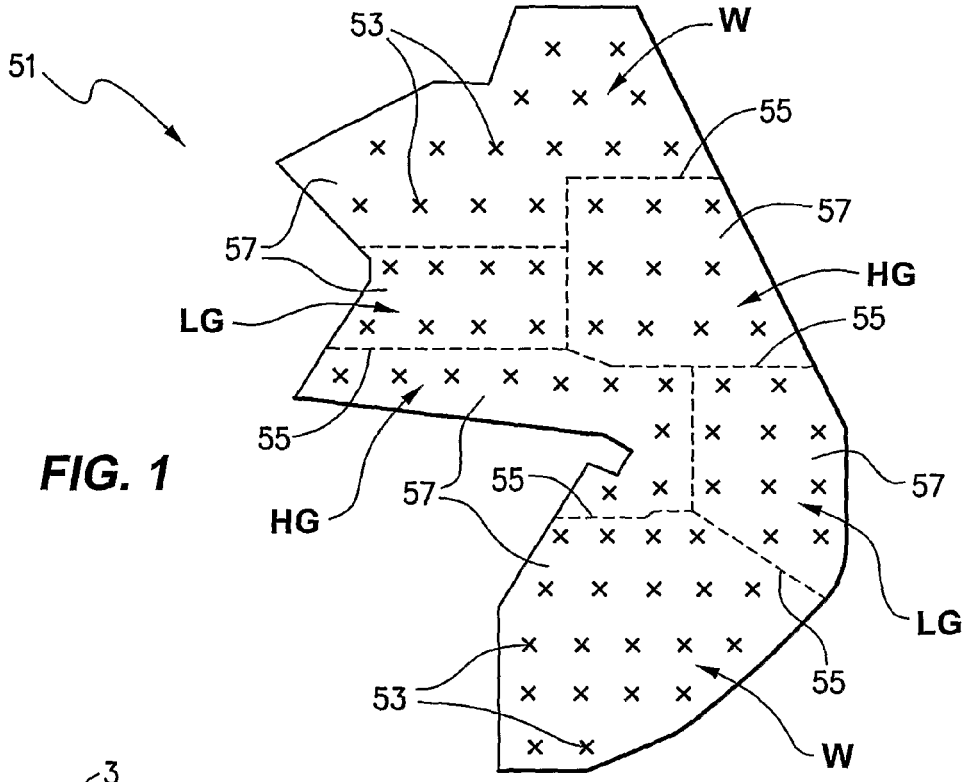

| | | | | |
|---|---|---|---|---|
| 4,321,134 | A * | 3/1982 | Leschonski et al. | 209/30 |
| 4,389,019 | A * | 6/1983 | Adrian et al. | 241/19 |
| 6,460,788 | B1 * | 10/2002 | de Feraudy | 241/19 |
| 2003/0183705 | A1 * | 10/2003 | Christiani et al. | 241/23 |
| 2006/0265342 | A1 * | 11/2006 | Froyland et al. | 705/500 |
| 2007/0023327 | A1 * | 2/2007 | Li et al. | 209/44 |

FOREIGN PATENT DOCUMENTS

| | | | | |
|---|---|---|---|---|
| CN | 1481940 | A | 3/2004 | |
| DE | 199 37 164 | A1 | 2/2001 | |
| RU | 2 292 963 | C1 | 2/2007 | |
| RU | 2292963 | C1 * | 2/2007 | B07B 13/00 |
| SU | 1802130 | A1 | 3/1993 | |
| WO | WO 2004/033854 | A1 | 4/2004 | |
| WO | WO 2008/065632 | A1 | 6/2008 | |

* cited by examiner

METHOD OF SORTING MINED, TO BE MINED OR STOCKPILED MATERIAL TO ACHIEVE AN UPGRADED MATERIAL WITH IMPROVED ECONOMIC VALUE

CROSS REFERENCE TO RELATED APPLICATIONS

This application is a national phase application based on PCT/AU2009/001364, filed Oct. 16, 2009, which claims the priority of Australian Patent Application No. 2008905365, filed Oct. 16, 2008, the content of both of which is incorporated herein by reference.

The present invention relates to sorting mined material.

The mined material may be metalliferous or non-metalliferous material. Iron-containing and copper-containing ores are examples of metalliferous materials. Coal is an example of a non-metalliferous material.

The term "mined material" is understood herein to include material that is mined and thereafter transferred to be processed in accordance with the invention and material that is mined and stockpiled and the thereafter transferred to be processed in accordance with the invention.

The present invention relates particularly although by no means exclusively to sorting iron ore.

It is known to mine iron ore in large blocks of the ore from benches. Typically, the blocks of ore are substantial, for example 40 m long by 20 m deep by 10 m high and contain 8000 tonnes of ore. Typically, a section of a bench is assayed by chemically analysing samples of ore taken from a series of drilled holes in the section to determine whether the ore is (a) high grade, (b) low grade or (c) waste material on a mass average basis. The cut-offs between high and low grades and between low grade and waste material are dependent on a range of factors and may vary from mine to mine and in different sections of mines. When the analysis is completed, a blockout plan of the section is prepared. The plan locates the drilled samples on a plan map of the section. Regions of (a) high grade, (b) low grade or (c) waste material are determined by sample analysis (such as chemical assay and/or mineral/material type abundances) and are marked on the plan, with marked boundaries separating different regions. The boundaries are also selected having regard to other factors, such as geological factors. The regions define blocks to be subsequently mined. Each block of ore is blasted using explosives and is picked up from a mine pit and transported from the mine pit. The ore is processed inside and outside the mine pit depending on the grade determination for each block. For example, waste ore is used as mine fill, low grade ore is stockpiled or used to blend with high grade ore, and high grade ore is processed further as required to form a marketable product.

The further processing of high grade ore ranges from simple crushing and screening to a standard size range through to processes that beneficiate or upgrade the iron ore. The processing may be wet or dry.

A significant proportion of low grade ore is not blended and remains as stockpiled ore. As a consequence, there are large stockpiles of mined ore that have been classified as low grade ore that have potentially significant economic value notwithstanding the low grade of the ore.

The present invention is a method of sorting mined material (including stockpiled mined material), such as iron ore, that comprises assessing whether a volume of a material is upgradable and, if so, separating the material, for example on the basis of grade.

The term "upgradable" is understood herein to mean that the material is a material that is capable of being dry sorted to improve the actual or potential economic value of the material.

The criteria for deciding whether, a material (including material to be mined and stockpiled material) is upgradable is not limited to the grade and may include factors relevant to a particular mine, such as the characteristics of the material, and may include other factors such as market requirements for the material. The material characteristics may include the extent to which valuable constituents of a material can be liberated, for example by particle size reduction, the mineral abundances, and material types.

In some situations the term "upgradable" may be understood herein to mean that there is a range of grades in the individual particles making up the material in a volume of material to be mined, such as a block of the type described above, whereby some particles are higher grades than other particles, and there would be a benefit in separating the volume of material into higher and lower grade components.

In other situations the term "upgradable" may also be understood herein to mean that there is a range of grades of materials in the particles of material in a stockpile of mined material that has been classified as low grade material, whereby some particles are higher grades than other particles, and there would be a benefit in separating the stockpiled material into higher and lower grade components.

In other situations the term "upgradable" may also be understood herein to mean that the material contains particles of "impurities" within a volume of material to be mined or in a stockpile. For example, in the context of coal, the impurities may comprise any one or more of shale and silica and other ash components.

The term "grade" as used herein is understood to mean an average of the amount of a selected constituent in a given volume of particles of a mined material, such as ore, expressed as a percentage, with the grade calculation being based on amounts by weight. In the context of iron ore, grade relates to the percentage by weight of iron and other constituents of the ore that are considered to be important by customers. The other constituents include, by way of example, silica, aluminium, and phosphorous.

According to the present invention there is provided a method of sorting mined material, such iron ore, that comprises:

(a) determining whether a volume of a material to be mined is upgradable as described herein and mining the volume of material or determining whether a volume of a material in a stockpile of mined material is upgradable as described herein; and (b) dry sorting the mined or stockpiled material that is determined to be upgradable and producing an upgraded mined material.

The term "dry sorting" is understood herein to mean any sorting process that does not require added moisture for the purpose of effecting separation.

The above-described method makes it possible to recover value from mined material such as iron ore that would otherwise be classified as low grade material or waste material, as described above on a mass average basis. This is particularly the case where the particles in the low grade material or waste material comprise one group of discrete particles that are above a threshold grade and another group of discrete particles that are below the threshold grade.

The method also makes it possible to recover value from mined material such as coal that contains particles of shale and silica or other "impurities" by separating coal particles and these "impurity" particles.

The method also makes it possible to take the as-mined material or stockpiled material and, given current mining practices, to subject the material to particle size reduction (such as crushing) and size separation to separate the material into a required product particle size distribution or distributions, and then to dry sort (as opposed to wet sort) the material that is in the required product size distribution to recover valuable material.

The method also makes it possible to take the as-mined material or stockpiled material and subject the material to particle size reduction and then dry sort an oversize fraction that is larger than a required product size distribution and return material that is above a threshold grade to the size reduction step.

The volume of material may be any suitable size having regard to the characteristics of a particular mine or a section of the mine to be mined. For example, the volume of material may be a block that is 40 m long by 20 m deep by 10 m high and containing 8000 tonnes of material.

Analysis step (a) may comprise taking a plurality of samples, such as drilled samples, from a volume of material to be mined, such as a block of ore of the type described above, prior to mining the material and analysing the samples, for example by determining the grade of each of the samples, and making an assessment of whether the ore in the volume of ore is upgradable.

Analysis step (a) may also comprise taking a plurality of samples from a stockpiled material and analysing the samples, for example by determining the grade of each of the samples, and making an assessment of whether the material in the stockpiled material is upgradable.

The number of samples required in any given situation will depend on factors relating to a particular mine or a section of the mine to be mined.

Any suitable technique may be used to analyse the samples in analysis step (a).

Dry sorting step (b) may be based on any suitable analytical technique.

There may be a correlation between the analysis technique used in the analysis steps (a) and the dry sorting step (b).

One suitable analytical technique is dual energy x-ray analysis. Other analytical techniques include, by way of example, x-ray fluorescence, radiometric, electromagnetic, optical, and photometric techniques. The applicability of any one or more of these (and other) techniques will depend on factors relating to a particular mine ore or a section of the mine to be mined.

The term "dual energy x-ray analysis" is understood herein to mean analysis that is based on processing data of detected transmitted x-rays obtained at different photon energies. Such processing makes it possible to minimise the effects of non-compositional factors on the detected data so that the data provides clearer information on the composition, type, or form of the material.

Dry sorting step (b) may comprise dry sorting on the basis of grade of particles of the material.

One, although not the only possible, option for dry sorting step (b), insofar as it relates to material for example in a stockpile that has a particle size distribution required for a product and therefore does not require particle size reduction prior to dry sorting step (b), may comprise a first dry sorting step, for example on the basis of a first grade determination, and a further dry sorting step or a series of such sorting steps on the material selected in the first sorting step.

For example, the grade cut-off for the first sorting step may be lower than the grade cut-off for the second and each successive sorting step so that there is progressive upgrading of the material. Consequently, for example, this dry sorting option makes it possible to separate "waste" material from "valuable" material in the first sorting step and then to separate the valuable material into two or more than two different grades in the further sorting step or steps. It is noted that the grades may be marketable grades. It is also noted that the grades may comprise marketable and nonmarketable grades. It is also noted that the grade separation provides an opportunity for blending a marketable grade material and a nonmarketable material to produce a blended marketable material for example having a target iron concentration.

One, although not the only possible, option for dry sorting step (b), insofar as it relates to material in a mined volume of material or in a stockpiled mined material that includes material that is oversize for a product, may comprise (i) a particle size reduction step, such as a crushing step, on the mined or stockpiled material to produce a size-reduced material and (ii) a particle size separation step that separates the size-reduced material that is a required product particle size distribution for a product and an oversize material. In this option, the step of dry sorting, for example on the basis of grade, may be carried out on the ore having the required product particle size distribution. Alternatively, in this option the step of dry sorting, for example on the basis of grade, may be carried out on material that is oversize to the required product size distribution, with the material that is above a grade cut-off being crushed and returned to the size separation step (ii) and then processed as described above.

More particularly, the dry sorting step (b) may comprise (i) a particle size reduction step, such as a crushing step, on the mined or stockpiled material to produce a size-reduced product, (ii) a size separation step that separates the size reduced material at least into an oversize fraction and an undersize fraction, with the oversize fraction being the required product particle size distribution for the product, and (iii) a dry sorting step on the oversize fraction from the size separation step for example that selects on the basis of grade.

The size separation step (ii) mentioned above may comprise a series of successive size separation steps. In that event, the oversize fraction may comprise the oversize fraction at the last of the size separation steps. Alternatively, the oversize fraction may comprise the oversize fraction at each of two or more than two size separation steps.

The series of successive size separation steps may comprise a size separation step that separates the size-reduced material into an oversize fraction and an undersize fraction, with the oversize fraction being material that is above a lower limit of the required product particle size distribution, a further size separation step that separates the oversize fraction into an oversize fraction and an undersize fraction, with the oversize fraction being material that is above an upper limit of the required product particle size distribution for the product, and with the undersize fraction being the required particle size distribution. The dry sorting step (b) may be carried out on the undersize fraction having the required particle size distribution.

The size separation step (ii) may comprise separating the size-reduced material into at least two different particle size fractions, with the combination of the size fractions being the required product particle size distribution for the product, and step (iii) may comprise sorting each size fraction, for example on the basis of grade.

The dry sorting step (b) may comprise one or more than one repeat of the above-described sequences of steps described in the preceding paragraph.

The above-described sequence of steps may progressively reject material that is undersize in relation to the required particle size distribution and only sort material, for example on the basis of grade, that has the required particle size distribution. This is advantageous in terms of minimising energy requirements for crushing material and maximising throughput of material.

Typically, the final sorting step in the above-described sequence of steps is carried out on the oversize fraction having a particle size range required for the product.

The final undersize fraction, typically a fines fraction, may be transferred to a stockpile as a waste product or be treated by other concentration methods, wet or dry.

The dry sorting steps described above produce "rejects" fractions that may be transferred to a stockpile or may be treated by other concentration methods, wet or dry.

By way of example, size separations may be carried out at (a) +/−160 mm, +/−75 mm, +/−32 mm, and +/−8 mm diameter particles, with the −8 mm material forming fines and the product size being in a range of 8-32 mm.

If further separation of the material selected in the final sorting step in the above-described sequence of steps is required, the selected material (which is in the required product size range) may be further processed in another sorting step that selects ore into at least two streams for example on the basis of grade, and, optionally, a further sorting step on the material selected in the previous sorting step to further select material, for example on the basis of grade.

Consequently, this further dry sorting option makes it possible to separate valuable material into two or more streams.

The size reduction step or steps may be carried out using crushers.

The size separation step or steps may be carried out using screens.

According to the present invention there is also provided a method of mining material that comprises:

(a) determining whether a volume of material to be mined is upgradable, as described herein;

(b) mining the volume of material; and (c) dry sorting the mined material that is determined to be upgradable and producing an upgraded material.

Dry sorting step (c) may comprise dry sorting on the basis of grade.

According to the present invention there is also provided a method of mining material that comprises:

(a) determining whether a volume of material in a stockpile is upgradable, as described herein; and (b) dry sorting the stockpiled material that is determined to be upgradable Dry sorting step (b) may be carried out on the basis of grade.

The method may comprise blending the sorted upgraded material with mined material.

The material may be mined by any suitable mining method and equipment. For example, the material may be mined by drilling and blasting blocks of ore from a pit and transporting the mined ore from the pit by trucks and/or conveyors. By way of further example, the material may be mined by surface miners moving over a pit floor and transported from the pit by trucks and/or conveyors.

According to the present invention there is also provided a method of blending material, such as iron ore, to produce a blended product having a target concentration that comprises (a) feeding material to a sorter and sorting the material into streams based on concentration of selected component of the material, with one stream being a lower grade stream comprising ore below the target concentration and another stream being a higher grade stream comprising ore above the target concentration, and combining portions of material from the lower grade stream and the higher grade stream together or separately or in combination with other material streams and producing a product stream having the target concentration.

The present invention is described further with reference to the accompanying drawings, of which:

FIG. 1 is an example of a blockout plan for a section of a mine bench in a conventional mining operation; and FIGS. 2 to 10 are a series of flowsheets illustrating a number of, although not the only, embodiments of the method of sorting ore in accordance with the present invention.

The description of the invention is in the context of a mined material in the form of iron ore. It is noted that the invention is not confined to iron ore and extends to other mined materials containing valuable components.

FIG. 1 is a blockout plan for a section 51 of a bench in an open pit iron ore mine operating as a conventional mine. The plan shows the locations of a series of drilled holes 53 (indicated by crosses) that have been drilled to obtain samples. The samples are analysed to determine the grade of ore in the samples. The plan also shows assayed and is marked with a series of boundaries 55 that divide the section into a series of blocks 57 on the basis of whether the ore in the blocks is determined by the sample analysis to be (a) high grade, (b) low grade or (c) waste material based on ore grade. There are six blocks 57 shown in the Figure. High grade blocks 57 are referred to as "HG", low grade blocks are referred to as "LG", and waste blocks are referred to as "W" in the Figure. The cut-offs between high and low grades and between low grade and waste material are dependent on a range of factors and may vary from mine to mine and in different sections of mines. Each block 57 of ore is blasted using explosives and is picked up from a mine pit and transported from the mine pit. The ore is processed inside and outside the mine pit depending on the grade determination for each block. For example, waste ore is used as mine fill, low grade ore is stockpiled or used to blend with high grade ore, and high grade ore is processed further as required to form a marketable product. The processing may be wet or dry.

In a conventional mining operation, the low grade ore blocks are not usually blended with other ore and are stockpiled and not sold and hence represent significant lost economic value. However, some or all of these blocks may be suitable for upgrading in accordance with the present invention and are processed in accordance with the invention as described by way of example with reference to the flowsheets of FIGS. 2 to 10.

In the present invention, in the context of iron ore, the assessment of whether an ore is "upgradable" is based on the grade of a block and an assessment of other factors. The factors include whether the ore particles can be sorted into particle streams that are above or below a threshold grade. Upgradable ore includes ore that has discrete particles that are above the threshold grade and discrete particles that are below the threshold grade. The assessment may include assessing the extent to which size reduction of ore can separate ore into such discrete particles. Ore that has finely disseminated iron through all the particles is generally not upgradeable.

Each of the flowsheets shown in FIGS. 2 to 10 is described in the context of ore that has been transported from the mine pit to a primary crusher 3 and is crushed in the crusher. It is noted that the invention also extends to situations in which the ore is crushed and sorted in the mine pit.

Figure 2:
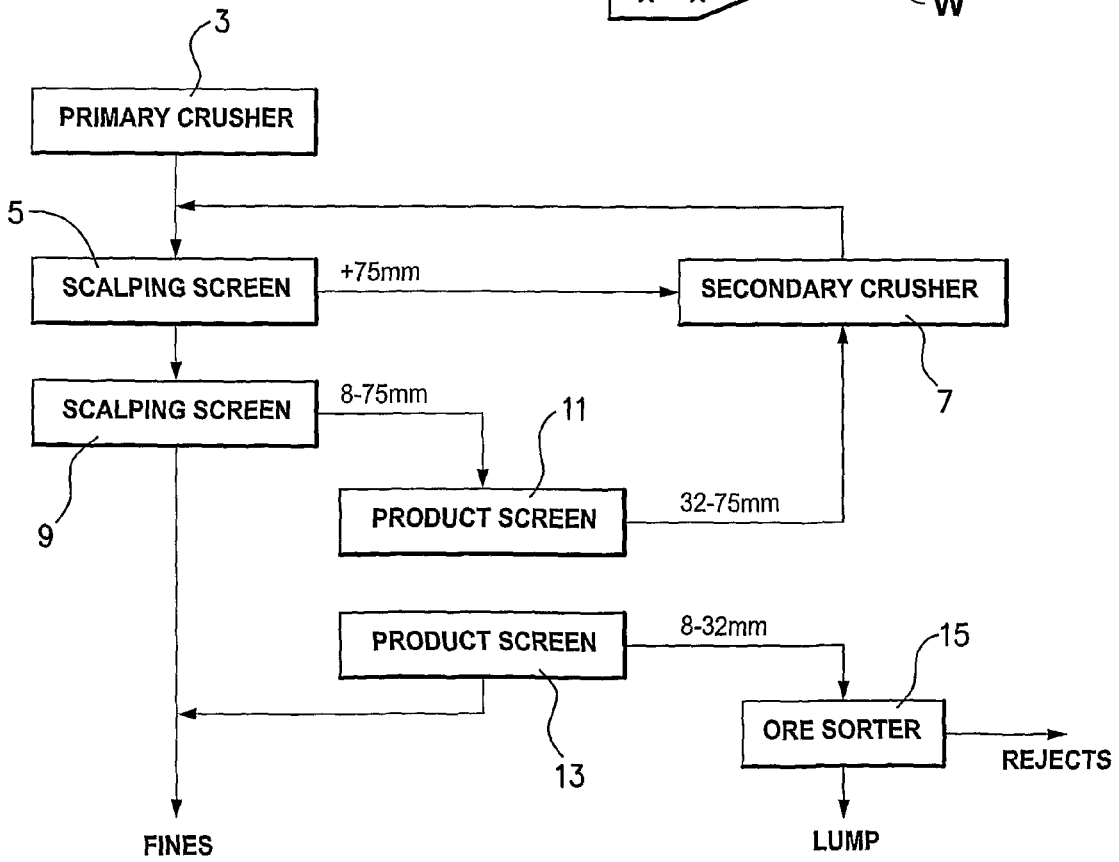

With reference to FIG. 2, the crushed ore from the primary crusher 3 is supplied to a scalping screen 5, for example in the form of a vibrating screen, that separates the ore on the basis of particle size into an oversize fraction of +75 mm and an undersize fraction of −75 mm.

The oversize fraction from the scalping screen 5 is transferred to a secondary crusher 7 and, after size reduction in the crusher, is transferred back to the stream from the primary crusher 3.

The undersize fraction from the scalping screen 5 3 is transferred to a downstream scalping screen 9, for example in the form of a vibrating screen, that separates the ore on the basis of particle size into an oversize fraction of 8-75 mm and an undersize fraction of −8 mm.

The undersize fraction from the scalping screen 9 is a fines stream that is transferred for further wet or dry processing.

The oversize fraction from the scalping screen 9 is transferred to a product screen 11, for example in the form of a vibrating screen. The product screen 11 separates the ore on the basis of particle size into an oversize fraction of 32-75 mm and an undersize fraction of −32 mm.

The oversize fraction from the product screen 11 is transferred to the secondary crusher 7 and, after size reduction in the crusher, is transferred back to the stream from the primary crusher 3.

The undersize fraction from the product screen 11 is transferred to downstream product screen 13 that separates the ore on the basis of particle size into an oversize fraction of 8-32 mm and an undersize fraction of −8 mm.

The undersize fraction from the product screen 13 is a fines stream that is transferred for further processing with the undersize fraction from the scalping screen 9.

The oversize fraction from the product screen 13 is a product stream, at least in terms of particle size distribution.

The oversize fraction from the product screen 13 is transferred to an ore sorter 15 and the particles are sorted on the basis of ore grade, i.e. average composition, of the particles into two streams. The sorter 15 (and the other ore sorters described hereinafter) may be a sorter that uses dual x-ray analysis or any other suitable analytical technique to determine ore grade. One stream, referred to as "lump" in the Figure, from the ore sorter 15 comprises ore that has an iron concentration above a threshold ore grade, for example 63 wt. % Fe. This stream is a required product stream, in terms of particle size distribution and composition, and forms a marketable product or a product that can be blended with other ore streams to produce a marketable product. The other stream, referred to as "rejects" in the Figure, from the ore sorter 15 comprises ore that has an iron concentration below a threshold ore grade, for example 63 wt. % Fe. This stream is transferred to a stockpile to be used, for example, as land fill.

A key feature of the above-described flowsheet is of FIG. 2 that the grade sorting step is carried out only on the ore that is in the required product particle size distribution, i.e. the 8-32 mm size fraction. This fraction is an oversize fraction from the product screen and there is no ore sorting of fines.

Figure 3:
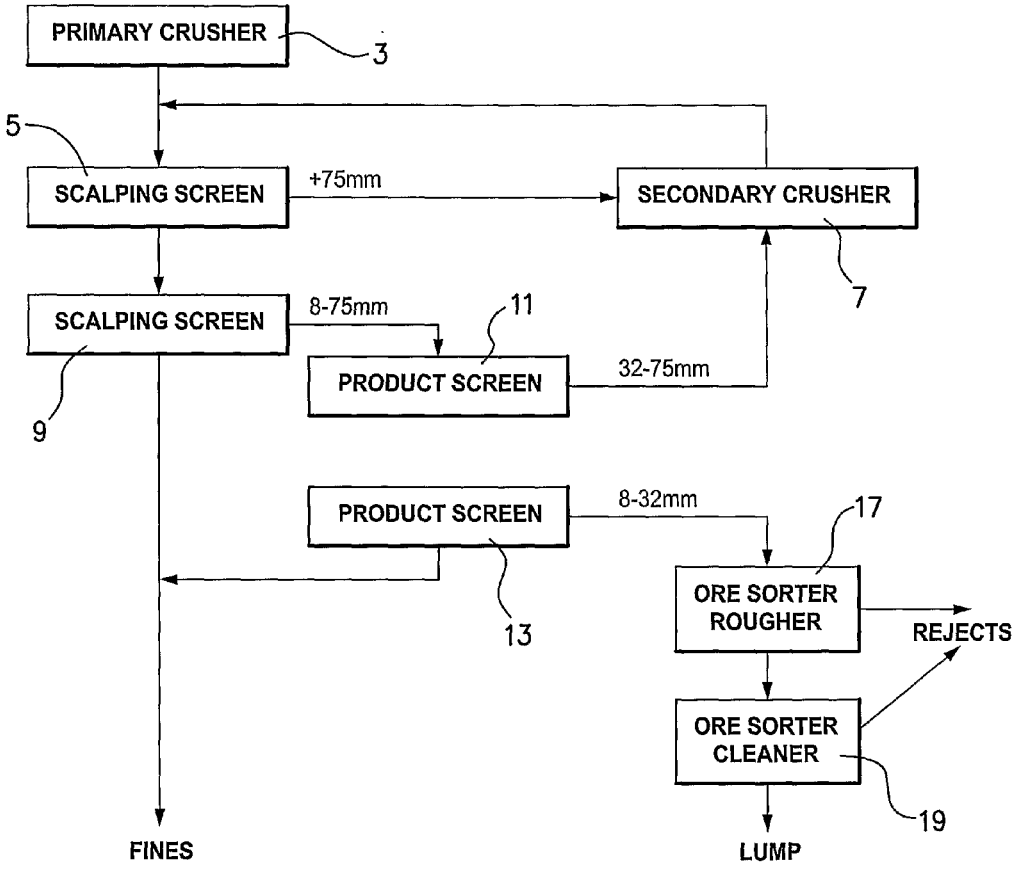

With reference to FIG. 3, there are significant similarities between this flowsheet and the FIG. 2 flowsheet and, hence, the same reference numerals are used to describe the same features.

The main difference between the flowsheets is in the grade sorting steps of the FIG. 3 flowsheet.

Specifically, the FIG. 3 flowsheet includes two ore sorters 17, 19 that sort the oversize fraction from the product screen 13 on the basis of ore grade rather than the single ore sorter 15 in the FIG. 2 flowsheet. As noted above in relation to the FIG. 2 flowsheet, this oversize fraction is the required product particle size distribution, i.e. the 8-32 mm size fraction.

More specifically, the ore sorter 17 acts as a form of "rougher" sorter and separates the ore stream into a first stream that has an iron concentration above a first grade threshold, for example 50-55 wt. % Fe, and a second stream, which is referred to as a "rejects" stream in the Figure, that has an iron concentration below the first grade threshold. The first stream is transferred to the ore sorter 19.

The ore sorter 19 acts as a form of "cleaner" sorter and separates the first ore stream, which comprises ore that is at least 50 wt. % Fe, into a first stream that has an iron concentration above a second grade threshold, for example 63 wt. % Fe and is referred to as a "lump" stream in the Figure and a second stream that has an iron concentration below the second grade threshold and is referred to as a "rejects" stream in the Figure.

The first "lump" stream from the ore sorter 19 is the required iron ore product in terms of particle size distribution and composition.

The second "rejects" stream i.e. the "rejects" stream from ore sorter 17, which comprises ore that is between the first and second grade thresholds, namely between 50-63 wt. % Fe, may be stockpiled and used for blending with higher grade streams.

The above-described combination of ore sorters 17, 19 makes it possible to maximise the recovery of the higher grade, i.e. +63 wt. % Fe, product in the 8-32 mm size fraction from the product screen 13 at high throughput. This higher grade product is described herein as the required iron ore product.

Figure 4:
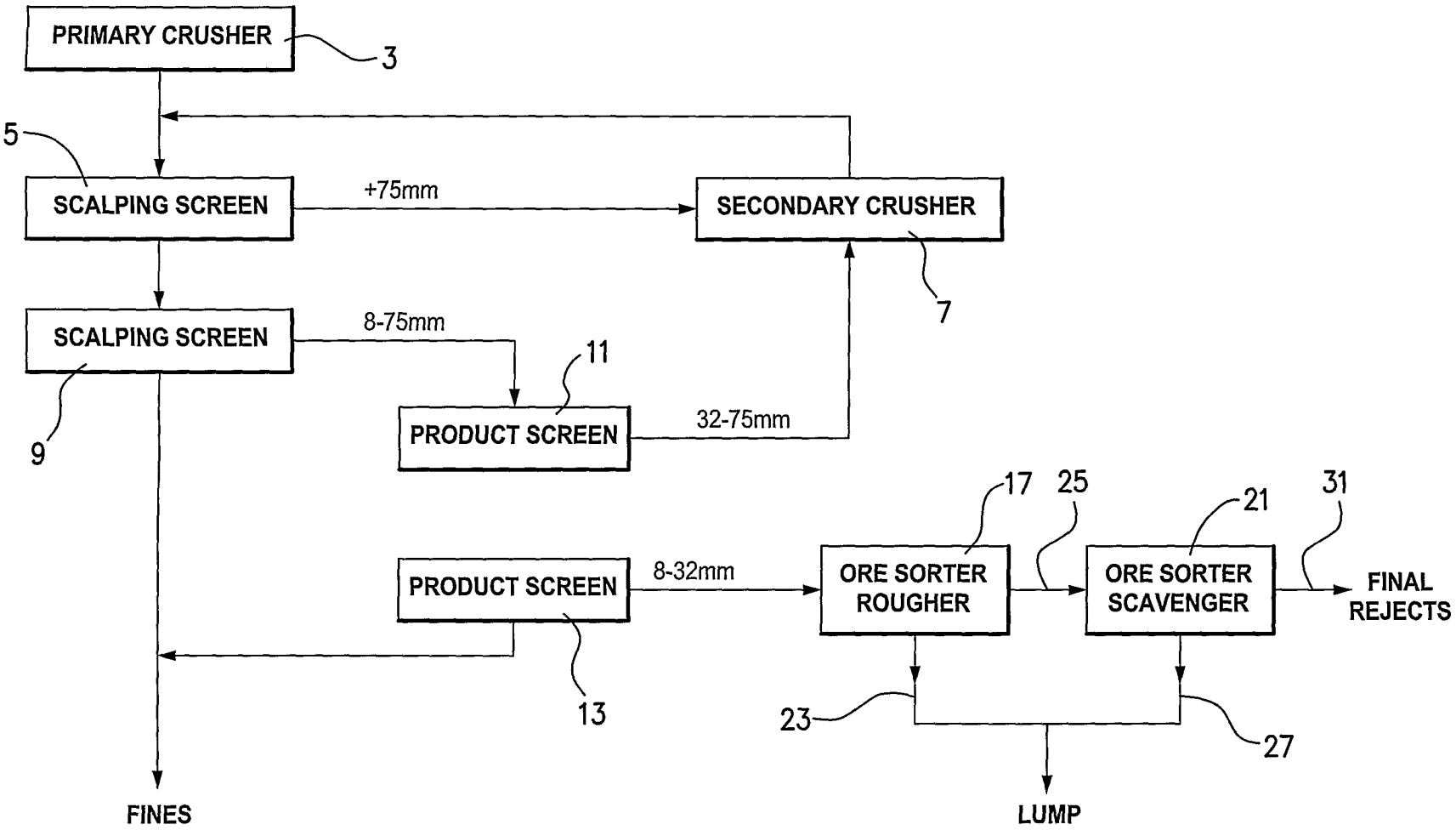

With reference to FIG. 4, there are significant similarities between this flowsheet and the FIGS. 1 and 2 flowsheets and, hence, the same reference numerals are used to describe the same features.

The main difference between the flowsheets is in the grade sorting steps of the FIG. 4 flowsheet. The main purpose of the sorting steps is to produce a high grade stream in the first sorting step.

Specifically, the FIG. 4 flowsheet includes two ore sorters 17, 21 that sort the oversize fraction from the product screen 13 on the basis of ore grade. As noted above in relation to the FIGS. 2 and 3 flowsheets, this oversize fraction is the required product particle size distribution, i.e. the 8-32 mm size fraction.

More specifically, the ore sorter 17 acts as a form of "rougher" sorter and separates the oversize fraction into a first stream 23 that has an iron concentration at or above a product grade threshold, for example 63 wt. % Fe, and a second stream 25 that has an iron concentration below the product grade threshold. The product stream 23 is the required iron ore product, in terms of particle size distribution and composition.

The ore sorter 21 acts as a form of "scavenger" sorter to identify and separate any ore particles in the second stream 25 that are at or above the above-mentioned product grade threshold. The ore sorter 21 captures this ore in a stream 27 and combines this stream with stream 23. The combined streams 23 and 27 make up the required iron ore product, in terms of particle size distribution and composition. The other stream 31 from the sorter 21 is a "rejects" stream.

Figure 5:
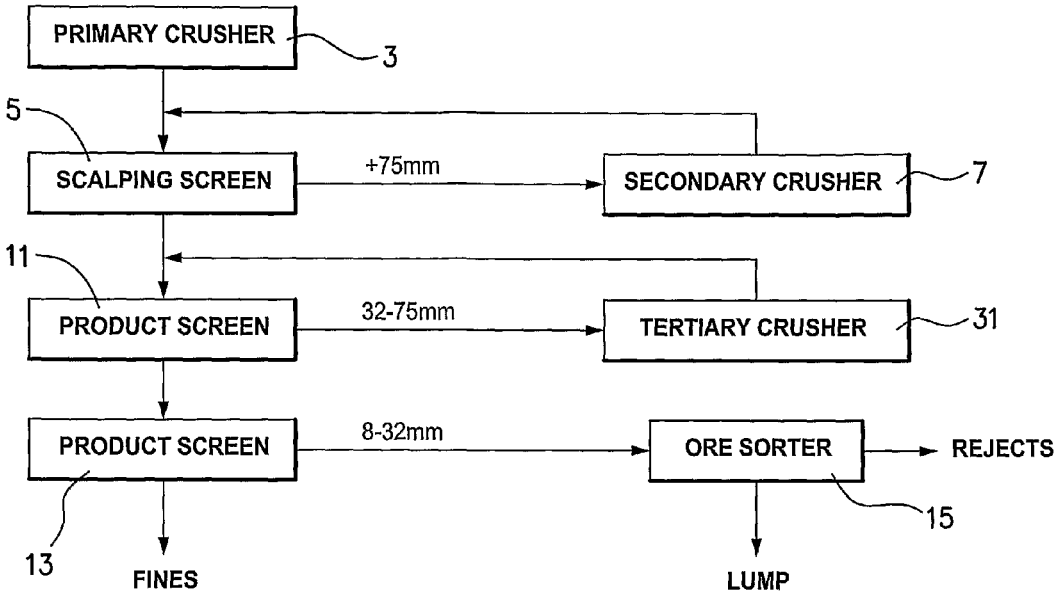

With reference to FIG. 5, there are significant similarities between this flowsheet and the FIG. 2 flowsheet and, hence, the same reference numerals are used to describe the same features.

The main difference between the flowsheets is in the size reduction and separation steps of the FIG. 5 flowsheet.

Specifically, the FIG. 5 flowsheet includes three stages of crushing whereas the FIG. 2 flowsheet includes two stages of crushing only.

The undersize fraction from the scalping screen 5 is transferred to a downstream product stream 11 that separates the ore into an oversize fraction of 32-75 mm and an undersize fraction of −32 mm.

The oversize fraction from the product screen 11 is transferred to the tertiary crusher 31 and, after size reduction in the crusher, is transferred back to the undersize fraction from the scalping screen 5.

The undersize fraction from the product screen 11 is transferred to a downstream product screen 13 that separates the ore on the basis of particle size into an oversize fraction of 8-32 mm and an undersize fraction of −8 mm.

The undersize fraction from the product screen 13 is a fines stream that is transferred for further processing.

The oversize fraction from the product screen 13 is a product stream, at least in terms of particle size distribution. The oversize fraction from the product screen 13 is transferred to an ore sorter 15 and sorted on the basis of ore grade as described above in relation to the FIG. 2 flowsheet to form the required iron ore product.

Figure 6:
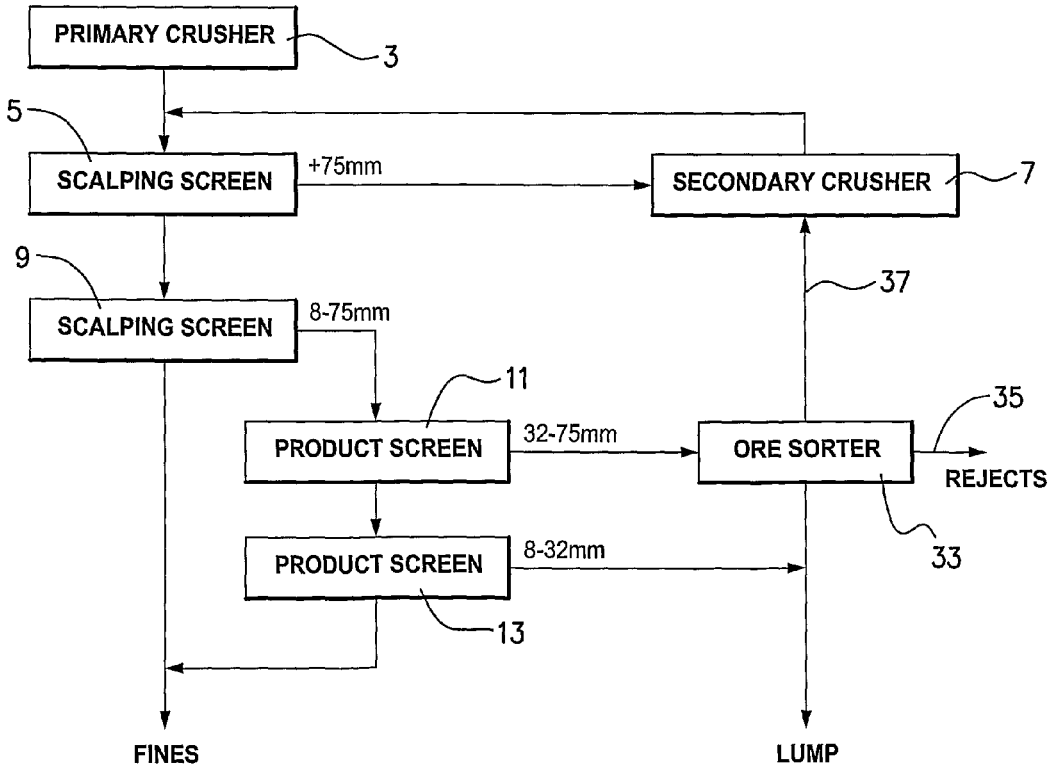

With reference to FIG. 6, there are significant similarities between this flowsheet and the FIG. 2 flowsheet and, hence, the same reference numerals are used to describe the same features.

The main difference between the flowsheets is in the processing of the ore after the product screen 11.

Specifically, in the FIG. 6 flowsheet the oversize fraction, i.e. the 32-75 mm fraction, from the product screen 11 is transferred to an ore sorter 33 and separated on the basis of grade into two streams 35, 37. Stream 35 comprises ore particles that have an iron concentration above a threshold value, for example 40 wt % Fe, and stream 37 comprises ore that has an iron concentration below the threshold value. The stream 37 is transferred to the secondary crusher 7 and, after size separation in the crusher, is transferred back to the stream from the primary crusher 3. The stream 35 from the ore sorter 33 is a "rejects" stream.

The undersize fraction, i.e. the −32 mm fraction, from the product stream 11 is transferred to the product screen 13.

The undersize fraction from the product screen 13 is a fines stream that is transferred for further processing with the undersize fraction from the scalping screen 9.

The oversize fraction from the product screen 13 is the required iron ore product, in terms of particle size distribution and composition. This flowsheet is applicable in situations where there is only a small proportion of the initial feed material that is in the required product size distribution, namely 8-32 mm.

Figure 7:
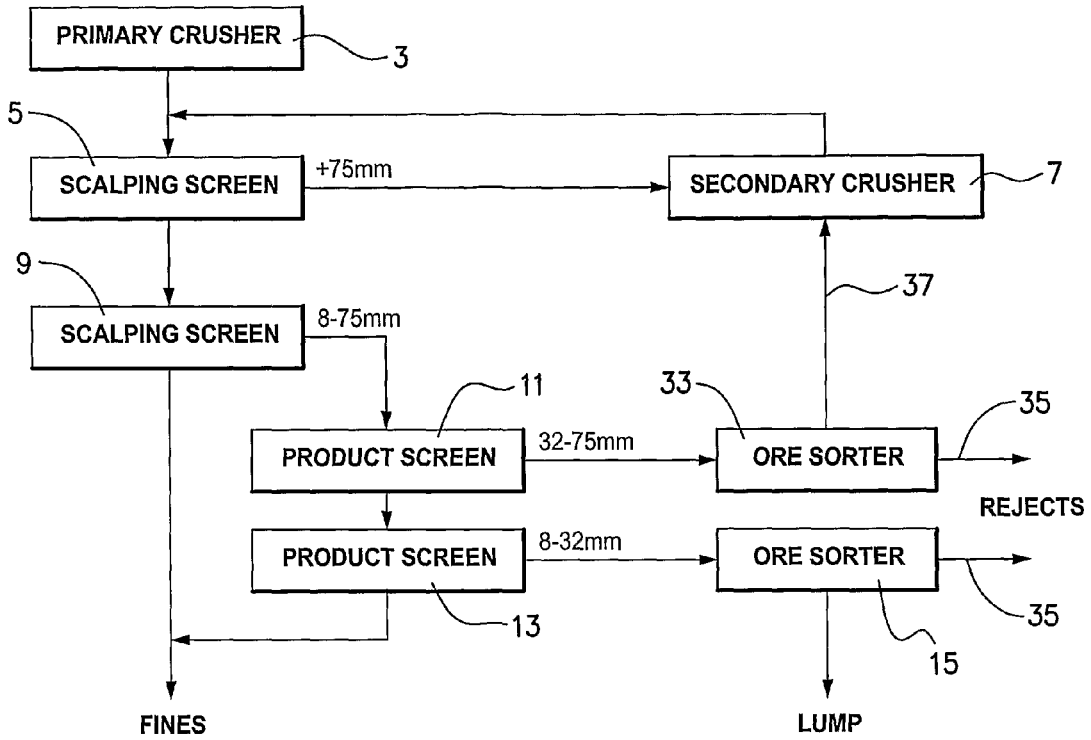

With reference to FIG. 7, there are significant similarities between this flowsheet and the FIG. 6 flowsheet and, hence, the same reference numerals are used to describe the same features.

The main difference between the flowsheets is in the processing of the oversize fraction of the ore from the product screen 13. Specifically, in the FIG. 7 flowsheet, the oversize fraction from the product screen 13 is a product stream in terms of particle size distribution only and not in terms of ore grade. The oversize fraction is transferred to the ore sorter 15 and sorted on the basis of ore grade, i.e. average composition, into two streams, as described above in relation to the FIG. 2 flowsheet to form the required iron ore product.

Figure 8:
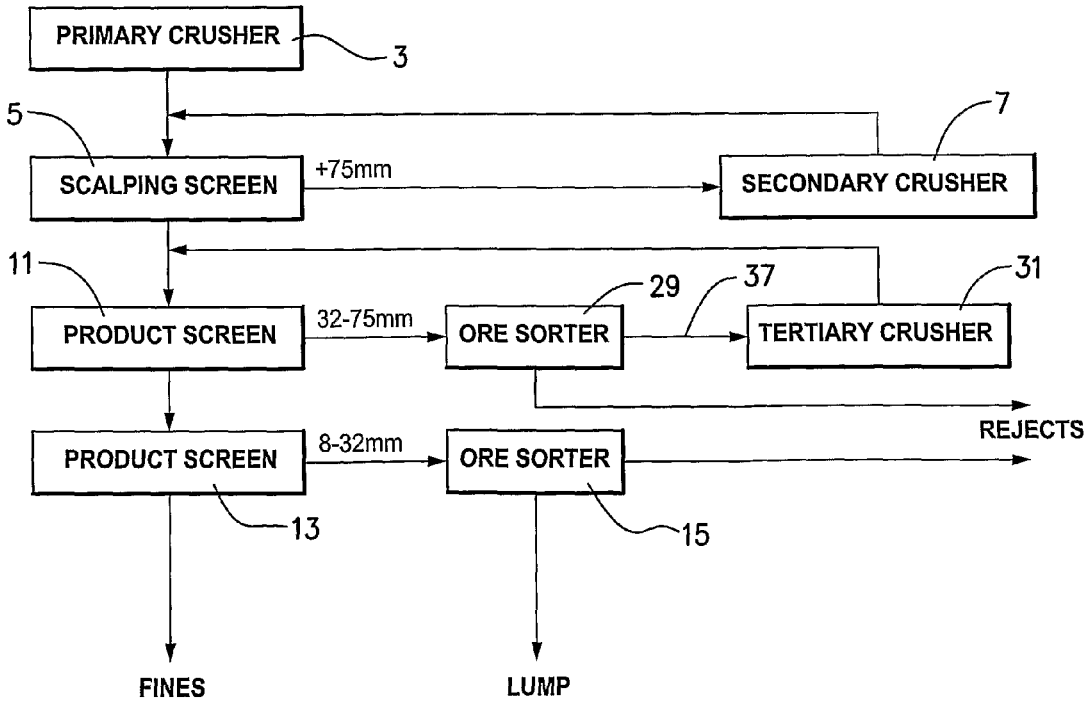

With reference to FIG. 8, there are significant similarities between this flowsheet and the FIG. 5 flowsheet and, hence, the same reference numerals are used to describe the same features.

The main difference between the flowsheets is in the processing of the stream 37 from the ore sorter 29 that has an ore grade above a threshold value, for example 50 wt. % Fe. Specifically, in the FIG. 8 flowsheet the stream 37 is transferred to the tertiary crusher 31 and, after size reduction in the crusher, is transferred back to the undersize fraction from the scalping screen 5.

Figure 9:
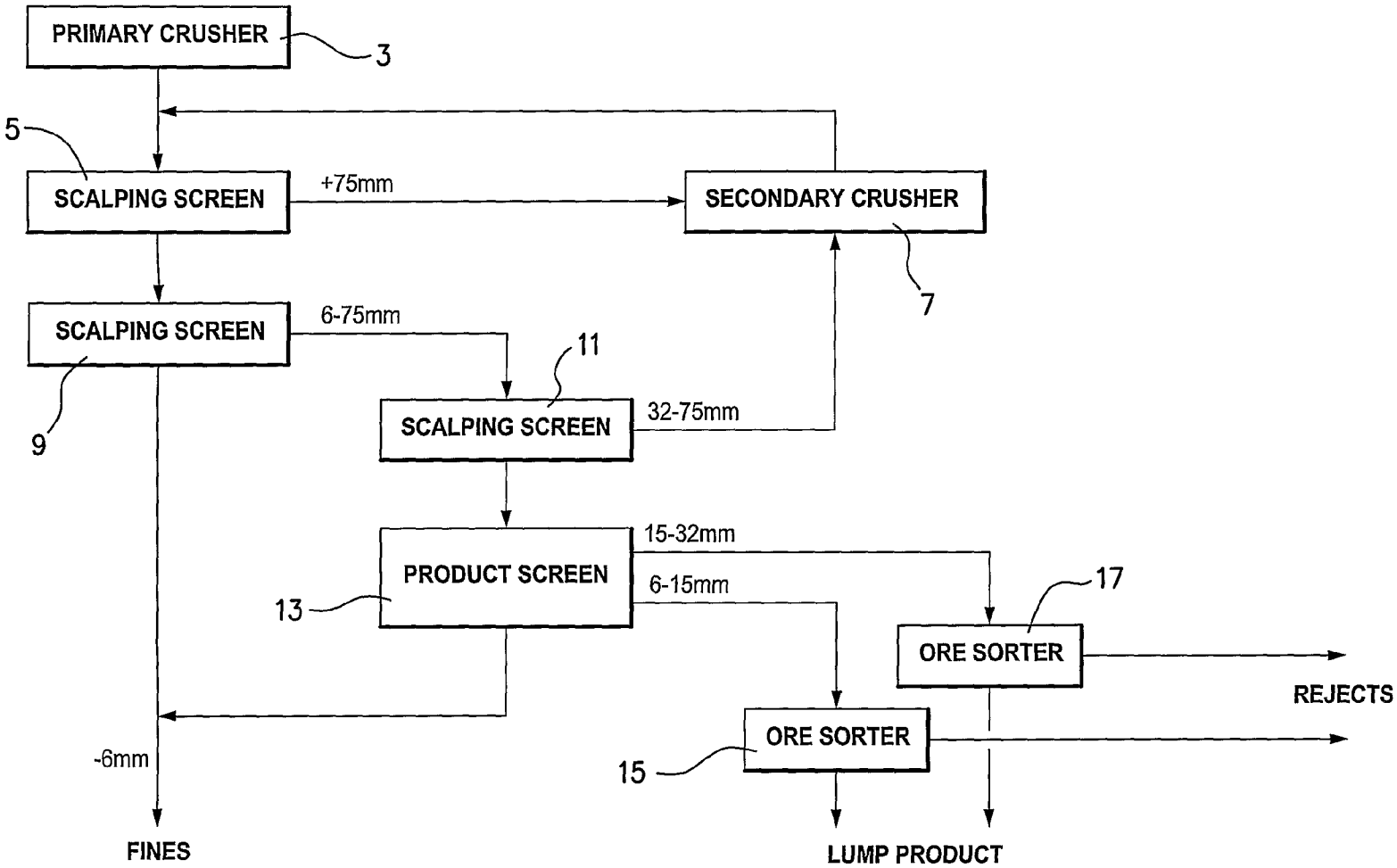

With reference to FIG. 9, there are significant similarities between the flowsheet and the other flowsheets described above and hence the same reference numerals are used to describe the same features.

A key feature of the FIG. 9 flowsheet is splitting the product size fraction of 6-32 mm into two product streams and separately sorting these streams.

With reference to FIG. 9, the crushed ore from the primary crusher 3 is supplied to a scalping screen 5, for example in the form of a vibrating screen, that separates the ore on the basis of particle size into an oversize fraction of +75 mm and an undersize fraction of −75 mm.

The oversize fraction from the scalping screen 5 is transferred to a secondary crusher 7 and, after size reduction in the crusher, is transferred back to the stream from the primary crusher 3.

The undersize fraction from the scalping screen 5 is transferred to a downstream scalping screen 9, for example in the form of a vibrating screen, that separates the ore on the basis of particle size into an oversize fraction of 6-75 mm and an undersize fraction of −6 mm.

The undersize fraction from the scalping screen 9 is a fines stream that is transferred for further wet or dry processing.

The oversize fraction from the scalping screen 9 is transferred to a scalping screen 11, for example in the form of a vibrating screen. The scalping screen 11 separates the ore on the basis of particle size into an oversize fraction of 32-75 mm and an undersize fraction of −32 mm.

The oversize fraction from the scalping screen 11 is transferred to the secondary crusher 7 and, after size reduction in the crusher, is transferred back to the stream from the primary crusher 3.

The undersize fraction from the scalping screen 11 is transferred to a product screen 13, for example in the form of a series of vibratory screens. The product screen 13 separates the ore on the basis of a particle size into two oversize fractions on 15-32 mm and 6-15 mm and an undersize fraction of −6 mm.

The undersize fraction from the product screen 13 is a fines stream that is transferred for further processing with the undersize fraction from the scalping screen 9.

The oversize fractions from the product screen 13 are product streams, at least in terms of particle size distribution.

The oversize fractions from the product screen 13 are transferred to respective ore sorters 15, 17 and the particles are sorted in each sorter on the basis of ore grade, i.e. average composition, of the particles into two streams. Two streams, referred to as "lump product" in the Figure, from the ore sorters 15, 17 comprise ore that has an iron concentration above a threshold ore grade, for example 63 wt. % Fe. These streams are required product streams, in terms of particle size distribution and composition, and form a marketable product or a product that can be blended with other ore streams to produce a marketable product. The other two streams, referred to as "rejects" in the Figure, from the ore sorters 15, 17 comprise ore that has an iron concentration below a threshold ore grade for example 63 wt. % Fe. These streams are transferred to a stockpile to be used, for example, as land fill.

Figure 10:
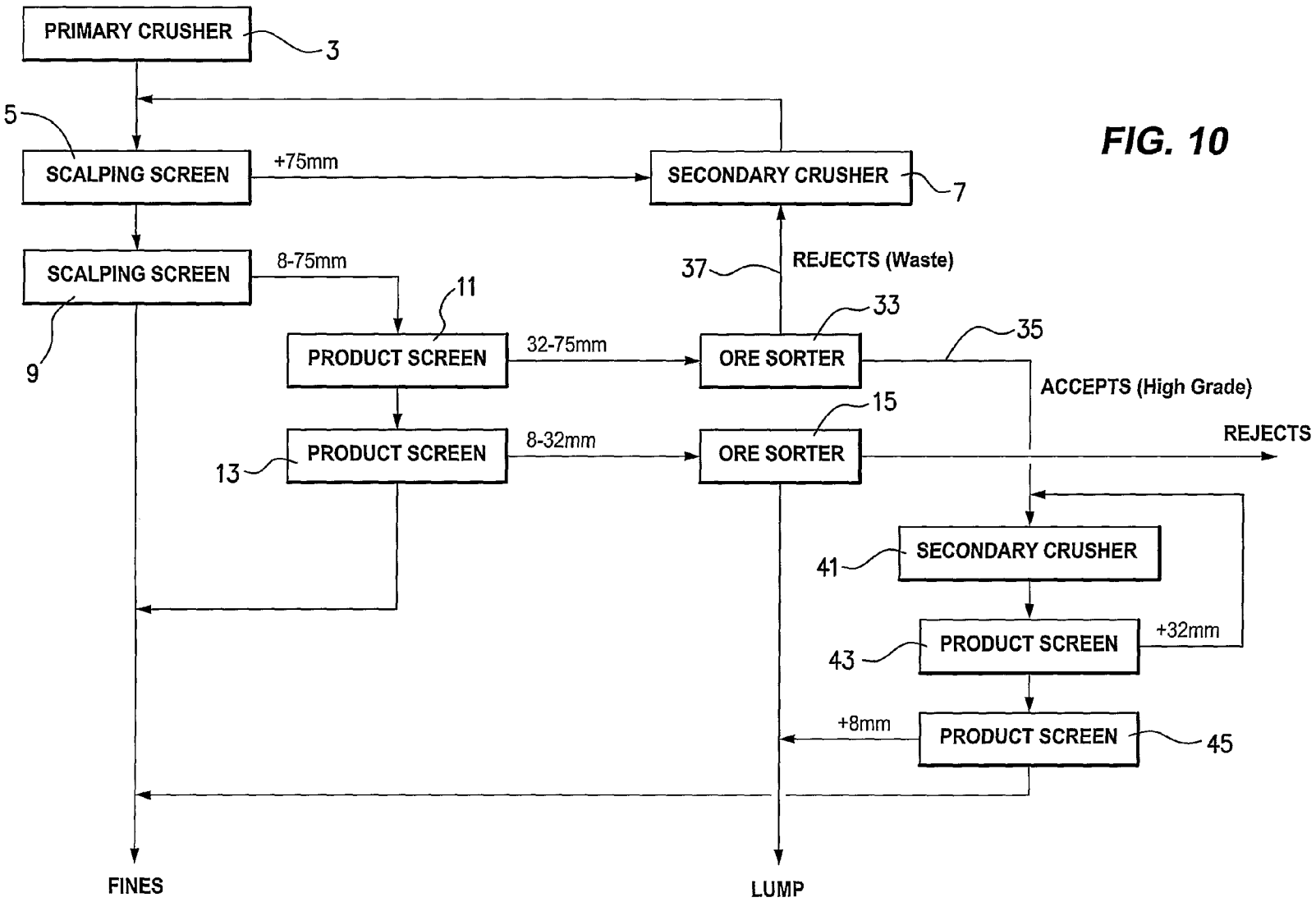

With reference to FIG. 10, there are significant similarities between the flowsheet and the other flowsheets described above and hence the same reference numerals are used to describe the same features.

A key feature of the FIG. 10 flowsheet is the treatment of the ore processed in the ore sorter 33.

Specifically, in the FIG. 7 flowsheet the oversize fraction, i.e. the 32-75 mm fraction, from the product screen 11 is transferred to an ore sorter 33 and separated on the basis of grade into two streams 35, 37. Stream 35 comprises ore particles that have an iron concentration above a threshold value, namely the product grade threshold of 63 wt. % Fe, and stream 37 comprises ore that has an iron concentration below the threshold value. The stream 37 is transferred to the secondary crusher 7 and, after size separation in the crusher, is transferred back to the stream from the primary crusher 3. The stream 35 from the ore sorter 33 is transferred to a separate secondary crusher 41 to the secondary crusher 7 and is crushed and thereafter transferred to a product stream 43. The product stream 43 separates the ore into a +32 mm oversize fraction and a −32 mm undersize fraction. The +32 mm size fraction is transferred back to the secondary crusher 41 for further crushing. The −32 mm size fraction is transferred to a product screen 45 and is separated into a +8 mm size fraction and a fines fraction. The +8 mm size fraction is in the required product size range and is combined with the product stream from the ore sorter 15.

The above-described embodiments are examples of a number of possible embodiments for sorting ore in accordance with the present invention. Each embodiment has particular features that may be appropriate depending on the requirements of a particular mining operation. The present invention extends to a significant range of other combinations of size reduction and dry sorting steps that would be readily apparent to a skilled person.

Many modifications may be made to the embodiments of the present invention described above in relation to FIGS. 2 to 8 without departing from the spirit and scope of the invention By way of example, whilst the embodiments comprise the use of scalping screens and product screens in the flowsheets, the screens may be any suitable screens and, moreover, the required size separation may be achieved by any suitable means and is not confined to the use of screens.

In addition, whilst the embodiments refer to particular size fractions, the present invention is not so limited and extends to separating ore into any suitable size fractions for a particular mine and mining operation and downstream market requirements. Specifically, it is noted that the present invention is not confined to product size fractions of 8-32 mm and 6-32 mm described in relation to the embodiments.

In addition, whilst the embodiments refer to particular grades, including a product grade, the present invention is not so limited and extends to any suitable grades for a given market.

The invention claimed is:

1. A method of sorting material that comprises:

(a) determining whether a volume of a material to be mined is low grade and upgradable and mining the volume of material or determining whether a volume of a material in a stockpile of mined material is low grade and upgradable, comprising assessing grade of the volume of material to determine whether the volume of material is low grade on an average basis across the volume of material and assessing whether ore particles in the volume of material can be dry sorted into streams that are above or below a threshold grade; and (b) dry sorting the mined or stockpiled low grade material of step (a) that is determined to be upgradable and producing an upgraded mined material from the low grade material.

2. The method defined in claim 1, wherein the analysis step (a) comprises taking a plurality of samples from a volume of material to be mined prior to mining the material and analysing the samples and making an assessment of whether the material in the volume of material is upgradable.

3. The method defined in claim 1, wherein the analysis step (a) comprises taking a plurality of samples from a stockpiled material and analysing the samples and making an assessment of whether the material in the stockpiled material is upgradable.

4. The method defined in claim 1, comprising using dual energy x-ray analysis as the basis for dry sorting step (b).

5. The method defined in claim 1, wherein dry sorting step (b) comprises dry sorting on the basis of grade.

6. The method defined in claim 1, insofar as it relates to material in a stockpile that has a particle size distribution required for a product and therefore does not require size reduction prior to dry sorting step (b), wherein the dry sorting step (b) comprises a first dry sorting step that selects material on the basis of a first grade determination and a further dry sorting step or a series of such dry sorting steps on the material selected in the first dry sorting step.

7. The method defined in claim 6, wherein the grade cut-off for the first sorting step is lower than the grade cut-off for the second and each successive sorting step.

8. The method defined in claim 6, wherein the grade cut-off for the first sorting step is higher than the grade cut off for the successive and each successive sorting step.

9. The method defined in claim 1, insofar as it relates to material in a mined volume of material or in a stockpiled material that includes material that is oversize for a product, wherein the dry sorting step (b) comprises (i) a size reduction step, such as a crushing step, on the mined or stockpiled material to produce a size-reduced material, and (ii) a size separation step that separates the size-reduced material at least into a material that is a required product particle size distribution for a product and an oversize material.

10. The method defined in claim 9, wherein the dry sorting of dry sorting step (b) is carried out on the material having the required product particle size distribution.

11. The method defined in claim 9, wherein the dry sorting step (b) is carried out on the material that is oversize to the required product size distribution, with the material that is above a grade cut-off being crushed and returned to the size separation step (ii).

12. The method defined in claim 9, wherein the dry sorting step (b) is carried out on the material that is oversize to the required product size distribution, with the material that is below a grade cut-off being crushed and returned to the size separation step (ii) and the material that is above the grade cut-off being crushed and further sorted.

13. The method defined in claim 9, wherein the dry sorting step (b) comprises (i) a size reduction step, such as a crushing step, on the mined or stockpiled material to produce the size-reduced ore, (ii) a size separation step that separates the size reduced material at least into an oversize fraction and an undersize fraction, with the oversize fraction being the required product particle size distribution for a product, and (iii) a dry sorting step on the oversize fraction from the size separation step.

14. The method defined in claim 1, wherein the size separation step (ii) comprises a series of successive size separation steps.

15. The method defined in claim 14, wherein the oversize fraction comprises the oversize fraction at the last of the size separation steps.

16. The method defined in claim 14, wherein the oversize fraction comprises the oversize fraction at each of two or more than two size separation steps.

17. The method defined in claim 14, wherein the series of successive size separation steps comprises a size separation step that separates the size-reduced material into an oversize fraction and an undersize fraction, with the oversize fraction being material that is above a lower limit of the required product particle size distribution for the product, a further size separation step that separates the oversize fraction into an oversize fraction and an undersize fraction, with the oversize fraction being material that is above an upper limit of the required product particle size distribution, and with the undersize fraction being the required particle size distribution.

18. The method defined in claim 17, wherein the dry sorting step (b) is carried out on the undersize fraction having the required particle size distribution.

19. The method defined in claim 13, wherein the size separation step (ii) comprises separating the size-reduced material into at least two different size fractions, with the combination of the size fractions being the required product particle size distribution for the product, and step (iii) comprises sorting each size fraction.

20. The method defined in claim 14, wherein the series of size separation steps progressively reject material that is undersize in relation to a required particle size distribution for a product and only sorts material on the basis of grade that has the required particle size distribution for the product.

21. A method of mining material that comprises: (a) determining whether a volume of material to be mined is low grade and upgradable, by assessing grade of the volume of material to determine whether the volume of material is low grade on an average basis across the volume of material and assessing whether ore particles in the volume of material can be dry sorted into streams that are above or below a threshold grade; (b) mining the volume of material from step (a) that is determined to be low grade and upgradable; and (c) dry sorting the mined low grade and upgradable material from step (b) and producing an upgraded material from the low grade material.

22. A method of mining material that comprises: (a) determining whether a volume of material in a stockpile is low grade and upgradable, by assessing grade of the volume of material to determine whether the volume of material is low grade on an average basis across the volume of material and assessing whether ore particles in the volume of material can be dry sorted into streams that are above or below a threshold grade; and (b) dry sorting the stockpiled material from step (a) that is determined to be low grade and upgradable and producing an upgraded material from the low grade material.

* * * * *